United States Patent [19]

Erikson

[11] 4,255,093

[45] Mar. 10, 1981

[54] COMBINED LIFT AND METERING PUMP

[75] Inventor: Robert W. Erikson, Rockford, Ill.

[73] Assignee: Sundstrand Corporation, Rockford, Ill.

[21] Appl. No.: 23,428

[22] Filed: Mar. 23, 1979

[51] Int. Cl.[3] ..... F04B 49/08; F04C 2/10; F04C 29/08

[52] U.S. Cl. ..... 417/310; 418/170; 418/183

[58] Field of Search ..... 418/15, 168–171, 418/183, 185; 417/310

[56] References Cited

U.S. PATENT DOCUMENTS

| | | | |
|---|---|---|---|
| 2,620,968 | 12/1952 | Nilsson | 418/15 |
| 3,473,477 | 10/1969 | Thompson et al. | 418/168 |
| 3,566,901 | 3/1971 | Swedberg | 137/87 |

FOREIGN PATENT DOCUMENTS

| | | |
|---|---|---|
| 592188 | 2/1934 | Fed. Rep. of Germany . |
| 2353019 | 12/1977 | France . |
| 2377006 | 8/1978 | France . |

*Primary Examiner*—John J. Vrablik

*Attorney, Agent, or Firm*—Wegner, Stellman, McCord, Wood & Dalton

[57] ABSTRACT

A combined lift and metering pump includes a set of relatively rotating pump elements in the form of an outer gear and a eccentrically disposed inner gear fixed on a drive shaft. A regulator communicates through a control passage with a discharge chamber of the pump to regulate fuel pressure in the discharge chamber and a metering orifice formed through the outer gear provides for intermittent communication with a timing port once with each revolution of the outer gear for discharging a metered amount of fuel from the discharge chamber.

6 Claims, 4 Drawing Figures

COMBINED LIFT AND METERING PUMP

TECHNICAL FIELD

The present invention relates generally to a lift pump such as may be used in pumping fuel oil from a storage tank to a burner nozzle for combustion in a heater. More particularly, the invention relates to a fuel pump of the type including relatively rotating pumping elements such as those employed in a gear pump capable of drawing liquid fuel from a tank at an elevation lower than the pump and discharging the fuel at a high pressure controlled by a regulator.

BACKGROUND ART

A representative prior art fuel pump of the crescent gear type is illustrated diagrametically and described in U.S. Pat. No. 3,566,901. In this type of lift pump, fuel is drawn from a supply, such as a tank mounted relatively lower than the pump, through an inlet port into the pump's housing by means of relatively rotatable pumping elements. The latter are mounted within a retaining ring and include inner and outer gears. The inner gear is fixed on a drive shaft whose axis is disposed eccentrically relative to the outer gear so that to one side of the shaft the teeth of the outer gear and inner gear mesh. To the opposite side of the shaft, is a space containing a crescent-shaped member allowing fuel to be transported in fluid chambers defined between the teeth on both the outer gear and inner gear. With rotation of the drive shaft, fuel is carried within these fluid chambers from the pump inlet to a discharge chamber with the meshing teeth of the gears pressurizing fuel in the discharge chamber. The latter communicates with a pressure regulator disposed within the housing and the regulator includes a spool movable axially within a bore. Under the urging of a spring reacting against one end of the bore, the spool is urged toward a position against a valve seat at the other end of the bore. Upon start up of the pump, when the pressure of the fuel discharged from the pump elements is sufficient to overcome the spring, the spool is shifted away from the valve seat thereby allowing high pressure fuel to be delivered to a burner nozzle communicating with a nozzle port. As the spool is shifted against the spring, a return port in the housing may be opened to allow excess fuel to be either returned to the inlet port, as in a one pipe lift fuel supply system, or to the supply tank as in a two pipe lift system. For fuel pressure adjustment purposes, an adjusting screw at the one end of the bore engages a movable spring seat so that the force of the spring acting against the valve spool may be adjusted to increase or decrease fuel pressure as desired to meet the pressure requirements of the particular heating system within which the pump is to be used.

Typically, pumps of the foregoing type are utilized in heating systems requiring fuel to be delivered at high pressure (100 psi–200 psi) but have a minimum firing rate of approximately 0.5 gph (gallons per hour) in order to avoid clogging of burner nozzle passages. Heretofore, it is by restricting the size of the burner nozzle passages that the minimum firing rates of 0.5 gph have been achieved with a crescent-type gear pump without the use of some form of auxiliary metering device. For example, U.S. Pat. No. 2,766,693 discloses a fuel pumping system which, in addition to a crescent-type gear pump, includes a metering pump for delivering fuel oil to a low pressure type atomizing nozzle.

DISCLOSURE OF THE INVENTION

The primary aim of the present invention is to provide a single pumping unit capable of performing both lift and metering functions in heating systems utilizing low pressure burner nozzles, that is, systems wherein the burner firing rates are below 0.5 gph and may be as low as 0.2 gph. More specifically, the present invention aims to provide a pump of the foregoing general character having relatively rotating pumping elements to produce a high pressure discharge which is directed through a metering orifice of sufficient size to avoid clogging problems while still reliably providing a low volume of flow to the burner nozzle. In the exemplary crescent-type gear pump, the metering orifice is located in the outer gear for intermittent communication with the pump's nozzle port. Normally, the nozzle port is not in communication with the high pressure fuel in the discharge chamber of the pump but, with each revolution of the outer gear, the metering port provides communication between the high pressure discharge fuel and the nozzle port for a pulse of fuel to flow from the pump discharge chamber, through the metering port, into a discharge passage and eventually to the nozzle port.

More particularly, a timing port within the housing is connected by the discharge passage with the nozzle port and the length of the timing port in the path of travel of the metering port determines the length of time within which fuel is pulsed through the metering port from the pump discharge chamber. Selection of the length of the timing port and adjustment of the discharge fuel pressure of the pump outlet chamber determines the rate of flow of fuel from the pump nozzle port.

BEST MODE FOR CARRYING OUT THE INVENTION

Figure 1:
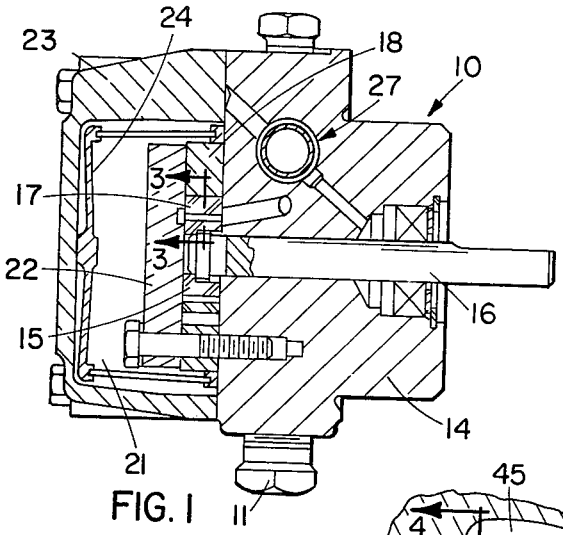
FIG. 1 is a cross-sectional view of a gear pump embodying the novel features of the present invention.
Figure 4:
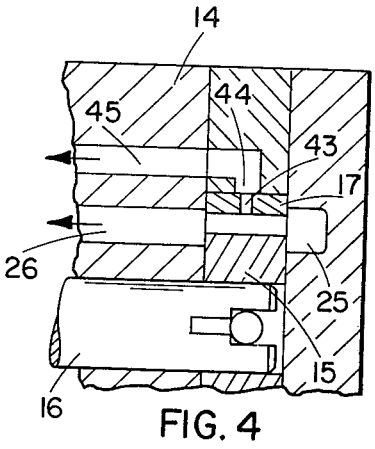
FIG. 4 is a cross-sectional view taken substantially along line 4—4 of FIG. 3.
Figure 3:
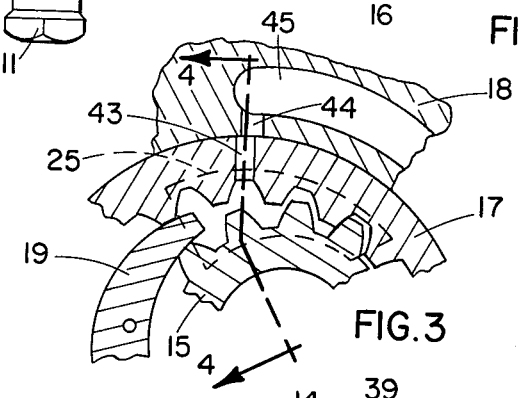
FIG. 3 is an enlarged cross-sectional view taken substantially along line 3—3 of FIG. 1.

As shown in the drawings for purposes of illustration, the present invention is embodied in a fuel pumping unit 10 of the type used in supplying fuel oil to a heating unit (not shown) such as a furnace or a boiler. Herein, the unit is disclosed for use in a so-called two pipe lift installation wherein fuel is fed through an inlet line (not shown) from a suitable source such as a fuel tank (not shown) to an inlet fitting or port 11. Excess oil from the pump exits through a return port 13 (see FIG. 2) to flow back to the source through a return line (not shown) connected to the return port. It will be appreciated, however, that with minor modifications, the present unit also may be employed in other types of installations, such as a one pipe lift installation, by closing the return port 13 and directing the return fuel back to the inlet port 11 for recirculation.

Figure 2:
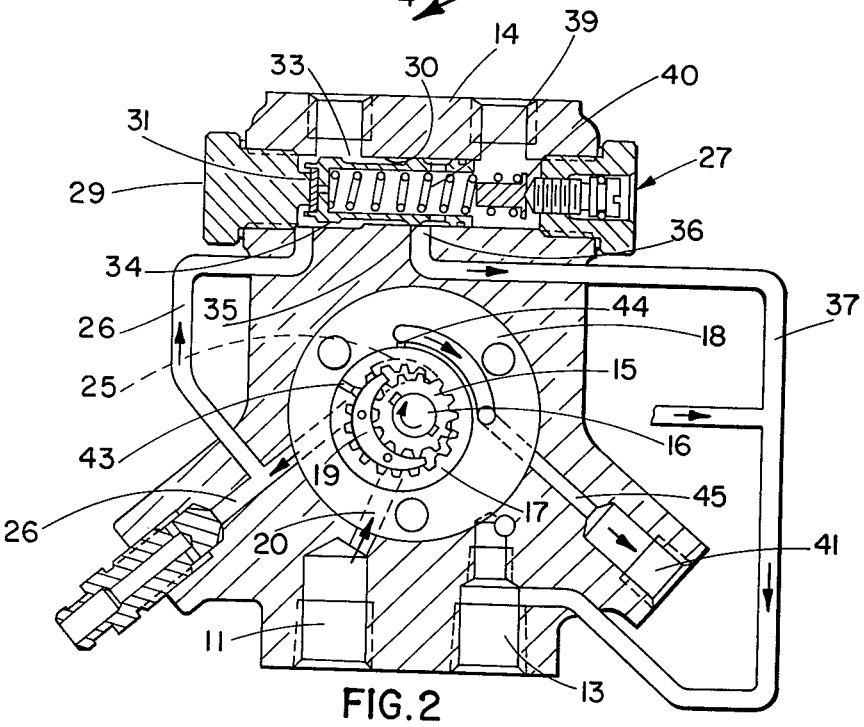
FIG. 2 is a schematic illustration of the pump shown in FIG. 1.

With reference to FIG. 1, the fuel pump 10 is of the crescent gear type including a housing casting 14 with an inner gear 15 mounted therein on a drive shaft 16 and eccentrically disposed with respect to an inter-meshing outer gear 17. The gears are relatively rotatable and serve as the pumping elements of the pump, both gears being captivated within a retaining ring 18 by means of an end plate 22 bolted to the casting. A crescent-shaped member 19 (see FIG. 2) is disposed within the space between the non-engaging portions of the teeth on the two gears for the purpose of sealing expanding fluid chambers defined between the gear teeth from the contracting fluid chambers in a well-known fashion. An inlet passage 20 of the pump communicates through the casting with the inlet port 11 by way of a reservoir 21 (see FIG. 1) which is defined by an end cover 23 bolted to the casting 14. A suitable strainer 24 located within the reservoir between the inlet port 11 and the inlet passage 20 serves to filter the fuel as it is drawn from the supply to the relatively rotating pumping elements or gears 15 and 17 of the pump. As shown in FIG. 2, the gears 15 and 17 transport fuel from the inlet passage 20 to a discharge chamber in the form of an outlet kidney 25 and, from the outlet kidney, the fluid flows into a control passage 26 communicating with a pressure regulator 27 which serves to regulate the pressure of the fuel at the outlet kidney 25 so as to be substantially constant.

Herein, the pressure regulator 27 is located within the casting 14 and abutts a fitting 29 threaded into a bore 30 extending through the casting. The fitting has a projection 31 defining a valve stop. More particularly, the pressure regulator includes a main pressure chamber 33 defined by the bore and communicating with pressure chamber is the control passage 26. A hollow valve member or spool 34 is slidably mounted within the main pressure chamber and includes a land 35 disposed centrally between opposite ends of the valve member. The land cooperates with a vent port 36 in the bore for venting fuel from the main pressure chamber to a return passage 37 communicating with the return port 13 through the casting 14.

In operation, pressurized fuel entering the main pressure chamber 33 from the gears 15 and 17 moves the valve member 34 to the right against the closing force of a coil compression spring 39 seated within the hollow portion of the valve member and reacting against a normally stationary, but adjustable spring seat 40 (see FIG. 2). When the pressure in the chamber is sufficient to overcome the closing force of the spring, the valve member will move to the right, opening the vent port 36 for fuel to flow through the return passage 37 and out the return port 13 to the fuel source. At normal operational speeds, the fuel flow from the relatively rotating gears 15 and 17 is sufficient to move the valve member 34 to the right far enough for the land 35 to uncover the vent port 36 so fuel continuously passes out the return port while the valve member, in conjunction with the spring 39, modulates a constant pressure fuel flow through the main pressure chamber, and, as a result, the pressure of the fuel in the outlet kidney 25 is maintained constant.

The present invention contemplates a unique modification to a lift pump of the foregoing general character whereby the pump will provide for metering of fuel to a burner nozzle at a low rate of flow. For this purpose, the relaitvely rotating pumping elements or gears 15 and 17 are utilized to provide an intermittent discharge of fuel from the discharge chamber 25 to a nozzle port 41 (see FIG. 2) formed in the pump housing casting 14. Accordingly, both lift and metering functions of the pump are achieved within a single pumping unit.

In the present instance, to provide for an intermittent or pulsing discharge of fuel to the nozzle port 41 of the pump casting 14, a metering orifice 43 is formed in the outer gear 17 and extends completely through the gear in a generally radial direction from between adjacent, consecutive teeth of that gear to the outer surface thereof. Accordingly, with each revolution of the outer gear, pressurized fuel in the outlet kidney 25 is free to flow through the orifice 43 as long as the orifice remains in communication with the outlet kidney.

Located within the path of travel of the metering orifice 43 is a timing port 44 formed within the retaining ring 18 and communicating with a discharge passage 45 formed through the retaining ring and the casting to communicate with the nozzle port 41 for fuel to flow from the metering orifice to the nozzle port. More particularly, the timing port is disposed within the retaining ring radially outward of the outlet kidney 25 so that communication is established between the pressurized fuel in the outlet kidney and the discharge passage 45 when the metering orifice 43 is in registry with the timing port 44. By selecting the length of the timing port in the path of travel of the metering orifice, the rate of flow of fuel from the outlet kidney may be varied. Additionally, adjustment of the regulator 27 for different pressure settings may be utilized to control the quantity of fuel passing from the outlet kidney into the discharge passage 45 with each revolution of the outer gear 17.

When the exemplary pump 10 is operated at high rotational speeds in the neighborhood of 3450 rpm, it has been found that the pulsing flow of fuel into the discharge passage 45 is such as to produce, in effect, a constant low rate of fuel flow at the nozzle port 41. Moreover, with both the metering orifice 43 and the timing port 44 being within the size range of 0.040–0.080 inches clogging problems are avoided while achieving discharge fuel flow rates of from 0.2–0.5 gph and higher if desired. Also, it will be appreciated that by discharging fuel from the outlet kidney 25 in a metered manner utilizing the outer gear 17, low flow discharge is achieved with a high pressure lift pump while still taking advantage of the air purging capabilities of such pumps upon start up.

I claim:

1. A metering pump including a housing, a drive shaft journaled within said housing, at least one rotatable pumping element within said housing, inlet and outlet chambers within said housing separated from each other but communicating with said pumping element, an inlet passage within said housing for connecting said inlet chamber with the source of fluid to be pumped, a discharge passage within said housing and having a relatively small fluid entry end defining a timing port selectively communicable with said outlet chamber for the discharge of fluid from said pump, means for regulating the pressure of fluid in said outlet chamber comprising passage means in parallel flow relation with said discharge passage and having a pressure regulator communicating with said outlet chamber and a return passage communicable with said pressure regulator for venting the fluid from said outlet chamber thereby to regulate the pressure of such fluid in said outlet chamber to a selected magnitude, said pumping element normally blocking fluid communication between said outlet chamber and the timing port of said discharge passage, and a metering orifice formed in said pumping element to establish intermittent fluid communication between said outlet chamber and the timing port of said discharge passage as said pumping element rotates within said housing to meter a preselected quantity of fluid from said pump with each revolution of said pumping element.

2. A metering pump as defined in claim 1 and having two rotatable pumping elements defined by inner and outer gears eccentrically disposed with respect to each other in the housing, a crescent member between the inner and outer gears, and said outer gear having said metering orifice.

3. A combined lift and metering pump including a housing, a drive shaft journaled within said housing, first and second relatively rotatable pumping elements within said housing, said first element being fixed for rotation with said shaft, inlet and outlet chambers within said housing separated from each other but communicating with said pumping elements, an inlet passage within said housing for connecting said inlet chamber with the source of fluid to be pumped, a discharge passage within said housing and having a relatively small fluid entry end defining a timing port selectively communicable with said outlet chamber for the discharge of fluid from said pump, means for regulating the pressure of fluid in said outlet chamber comprising passage means in parallel flow relation with said discharge passage and having a pressure regulator communicating with said outlet chamber and a return passage communicable with said pressure regulator for venting the fluid from said outlet chamber thereby to regulate the pressure of such fluid in said outlet chamber to a selected magnitude, one of said pumping elements normally blocking fluid communication between said outlet chamber and the timing port of said discharge passage, and a metering orifice formed in said one pumping element to establish intermittent fluid communication between said outlet chamber and the timing port of said discharge passage as said one pumping element rotates within said housing to meter a preselected quantity of fluid from said pump with each revolution of said one pumping element.

4. A combined lift and metering pump as defined by claim 3 wherein said regulator includes means for selective adjustment of the pressure of the fluid in the outlet chamber of said pump with resultant adjustment of flow through said discharge passage.

5. A combined lift and metering pump as defined in claim 3 wherein said first pumping element comprises a rotatable inner gear and said second pumping element is an outer gear, said inner and outer gears being mounted eccentrically relative to each other, and said metering orifice being located in said outer gear.

6. A combined lift and metering pump as defined by claim 5 wherein said metering orifice communicates through said outer gear between adjacent teeth of said outer gear.

* * * * *